US008221188B2

(12) United States Patent
Liu

(10) Patent No.: US 8,221,188 B2
(45) Date of Patent: Jul. 17, 2012

(54) BACK WING FOR BRASSIERE

(75) Inventor: Zhen Qiang Liu, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 414 days.

(21) Appl. No.: 12/468,353

(22) Filed: May 19, 2009

(65) Prior Publication Data

US 2010/0297911 A1 Nov. 25, 2010

(51) Int. Cl.
*A41C 3/00* (2006.01)

(52) U.S. Cl. ..... 450/74; 450/62

(58) Field of Classification Search ..... 450/85, 450/86, 39, 92, 93, 70–72, 74–76, 67, 79, 450/80, 19–21, 34, 35, 62–64
See application file for complete search history.

(56) References Cited

U.S. PATENT DOCUMENTS

| | | | | |
|---|---|---|---|---|
| 2,573,565 | A * | 10/1951 | Melick et al. | 144/144.1 |
| 2,666,919 | A * | 1/1954 | Banister | 450/36 |
| 3,093,137 | A * | 6/1963 | Dugan | 450/19 |
| 3,411,510 | A * | 11/1968 | Child | 450/70 |
| 3,548,832 | A * | 12/1970 | Rosner | 450/59 |
| 3,566,878 | A * | 3/1971 | Radomski | 450/65 |
| 3,665,929 | A * | 5/1972 | Brantly | 450/70 |
| 3,873,403 | A | 3/1975 | Edelman | |
| 5,447,462 | A * | 9/1995 | Smith et al. | 450/122 |
| 7,458,877 | B2 * | 12/2008 | Yu | 450/39 |
| 7,959,487 | B2 * | 6/2011 | Simpson | 450/39 |
| 7,963,822 | B2 * | 6/2011 | Simpson | 450/39 |
| 2002/0023709 | A1 | 2/2002 | Tedeschi et al. | |
| 2008/0032599 | A1 | 2/2008 | Kaye | |
| 2008/0280532 | A1 * | 11/2008 | Simpson | 450/39 |
| 2009/0061732 | A1 * | 3/2009 | Simpson | 450/41 |

OTHER PUBLICATIONS

Search Report for Great Britain Application No. GB1000830.8 mailed Jun. 15, 2010.

* cited by examiner

*Primary Examiner* — Gloria Hale
(74) *Attorney, Agent, or Firm* — Ostrolenk Faber LLP

(57) ABSTRACT

There is provided an improved brassiere comprising a pair of breast cups having adjacent but spaced apart inner edges; a front connector between the breast cups; and a back wing or pair of back wings extending from an outer edge of one of the two breast cups to an outer edge of the other of the two breast cups for securing the brassiere to a torso of a wearer; wherein each back wing comprises an elastane strap provided within a tube of elastic fabric. Also provided is an improved back wing for use on a brassiere and a method of making an improved back wing.

20 Claims, 2 Drawing Sheets

BACK WING FOR BRASSIERE

FIELD OF THE INVENTION

The present invention relates to a back wing as used in a brassiere and brassieres incorporating such a back wing. That is, the improved back wing may be an integral part of a brassiere or could be provided separately to be assembled together with other brassiere components to form a brassiere. A method of making an improved back wing is also provided.

BACKGROUND TO THE INVENTION

A conventional brassiere comprises of a pair of breast cups intended to cover and support the breasts of the wearer, a connector securing together the inner edges of the cups at the wearers cleavage, and at least one strap-like back or wing that extends from outer edges of the breast cups around the back of the wearer. The brassiere may further include shoulder straps that extend from upper edges of the breast cups over the shoulders of the wearer to attachment points on the strap-like back or wing crossing the wearers back.

It is also standard for a releasable closure to be provided either in the form of the connector securing together the inner edges of the cups at the wearer's cleavage hereinafter referred to as a front-closure type brassiere, or in a back-closure type brassiere, the back of the brassiere is formed by a pair of wings, one of which can be provided with at least one male closure member while the other is provided with at least one female closure member cooperating with the male closure member. The male closure member can be, for example, a metal hook while the female closure member can be an eye. This type of closures usually allows for some adjustment of the length of the wings enabling the wearer to adjust the back of the brassiere for optimum fit.

Generally the fabric wings of a brassiere include a rubber component to provide resilience. In particular, the rubber component is often provided at the edges of the back wing. While this structure provides the desired stretch and resilience, it is a disadvantage of using such rubber reinforcement that the wearer feels a localized pressure applied by the rubber to the skin causing a level of discomfort. This localised pressure zone may leave a mark on the wearers skin even once the garment if removed. Moreover, providing the rubber at the edges of the back wing results in a region of tightness where the fabric of the back wing is stretched which contrasts usually with a region of loose fabric between the edges of the back wing which are reinforced with rubber.

It would be desirable to provide an alternative back wing construction that can be used to manufacture a brassiere that is not only figure-enhancing, lightweight and aesthetically pleasing, but also comfortable to wear.

Other objects and advantages of the invention will become apparent to those of ordinary skill in the art having reference to the following specification together with its drawings.

SUMMARY OF THE INVENTION

According to an aspect of the present invention, there is provided an improved brassiere comprising:

a pair of breast cups having adjacent but spaced apart inner edges;

a front connector between the breast cups; and a back wing or pair of back wings, each back wing extending from an outer edge of at least one of the two breast cups;

wherein each back wing comprises an elastane strap provided within a tube of elastic fabric.

Where the brassiere comprises a single back wing as in the case of a front-closure type brassiere wherein a closure means is provided between the breast cups substantially at the wearers cleavage, the back wing extends from an outer edge of one of the two breast cups to an outer edge of the other of the two breast cups for securing the brassiere to the torso of the wearer. Where the brassiere comprises a pair of back wings as in the case of a back-closure type brassiere, the pair of back wings are releasably connected by a closure means for securing the brassiere to the torso of the wearer.

Preferably, the tube of elastic fabric is formed from two elongate pieces of fabric, each elongate piece of fabric having two edges running generally along the length of the piece of fabric, the edges of a first elongate piece of fabric and the edges of a second elongate piece of fabric being bonded together to form the tube.

In one particular form of the invention, the edges of the first elongate piece of fabric are bonded to the edges of the second elongate piece of fabric by ultrasonic welding.

In a preferred embodiment, the first elongate piece of fabric is wider or preferably slightly wider than the second elongate piece of fabric such that the first elongate piece of fabric is folded over proximal to its edges and the edges of the first elongate piece of fabric are bonded to the edges of the second elongate piece of fabric. In this form, once bonded, the edges of the first and second elongate pieces of fabric are contiguous. This arrangement provides a substantially even thickness over the entire length of the back wing, and a smooth surface to be worn against the wearers skin.

In another form, the edges of the first elongate piece of fabric may overlap the edges of the second elongate piece of fabric such that an inner edge of the first elongate piece of fabric is bonded to an outer edge of the second elongate piece of fabric. As a result the bond between the first elongate piece of fabric and the second elongate piece of fabric also can not be seen when the brassiere is fitted to a wearer. Moreover, the overlap or fold over of the first elongate piece of fabric over the edge of the second elongate piece of fabric may provide improved strength.

According to a preferred embodiment, the elastane strap is bonded to at least one of the elongate pieces of fabric. This is preferred since failure to bond the elastane to at least one of the first or second elongate pieces of fabric may result in folds appearing in the elongate pieces of fabric in relation to the more resilient elastane within the tube of fabric. The elastane strap may be bonded to the elongate piece of fabric by hot melt adhesive.

In one particular embodiment, the elastane strap comprises substantially 100% elastane.

Preferably, the elastic fabric exhibits stretch in at least one direction. More preferably, the elastic fabric includes an elastane component.

In a particular embodiment, the elastic fabric comprises substantially 88% nylon and substantially 12% elastane.

According to another aspect of the present invention, there is provided an improved back wing for a brassiere, such that the back wing extends from an outer edge of at least one of two breast cups of the brassiere;

the back wing comprising an elastane strap provided within a tube of elastic fabric.

Where the brassiere comprises a single back wing as in the case of a front-closure type brassiere wherein a closure means is provided between the breast cups substantially at the wearers cleavage, the back wing extends from an outer edge of one of the two breast cups to an outer edge of the other of the two breast cups for securing the brassiere to the torso of the wearer. Where the brassiere comprises a pair of back wings as in the case of a back-closure type brassiere, the pair of back wings are releasably connected by a closure means for securing the brassiere to the torso of the wearer. An improved back wing of the present invention may be used for one or both of such pair of back wings.

The tube of fabric may be formed from two elongate pieces of fabric, each elongate piece of fabric having two edges running generally along the length of the piece of fabric, the edges of a first elongate piece of fabric and the edges of a second elongate piece of fabric being bonded together to form the tube.

Preferably, the edges of the first elongate piece of fabric are bonded to the edges of the second elongate piece of fabric by ultrasonic welding. More preferably, the first elongate piece of fabric is wider or preferably slightly wider than the second elongate piece of fabric such that the first elongate piece of fabric is folded over proximal to its edges and the edges of the first elongate piece of fabric are bonded to the edges of the second elongate piece of fabric.

In another embodiment, the edges of the first elongate piece of fabric overlap the edges of the second elongate piece of fabric such that an inner edge of the first elongate piece of fabric is bonded to an outer edge of the second elongate piece of fabric.

According to another aspect of the present invention, there is provided a method of making an improved back wing, the method comprising the following steps:

forming a tube of elastic fabric from two elongate pieces of fabric, each elongate piece of fabric having two edges running generally along the length of the piece of fabric, the edges of a first elongate piece of fabric and the edges of a second elongate piece of fabric being bonded together to form the tube;

bonding an elastane strap to one of the elongate pieces of fabric forming part of the tube;

turning the tube inside out such that the elastane strip is located inside the tube; and trimming the tube of elastic fabric to size.

Preferably, the edges of the first elongate piece of fabric are bonded to the edges of the second elongate piece of fabric by ultrasonic welding.

Preferably, the elastane strap is bonded to the elongate piece of fabric forming part of the tube using holt melt adhesive.

BRIEF DESCRIPTION OF THE DRAWINGS

It will be convenient to hereinafter describe the invention in greater detail by reference to the accompanying figures which facilitate understanding of the method according to this invention. The particularity of the figures and the related description is not to be understood as superseding the generality of the broad identification of the invention as given in the attached claims.

DETAILED DESCRIPTION

Figure 1:
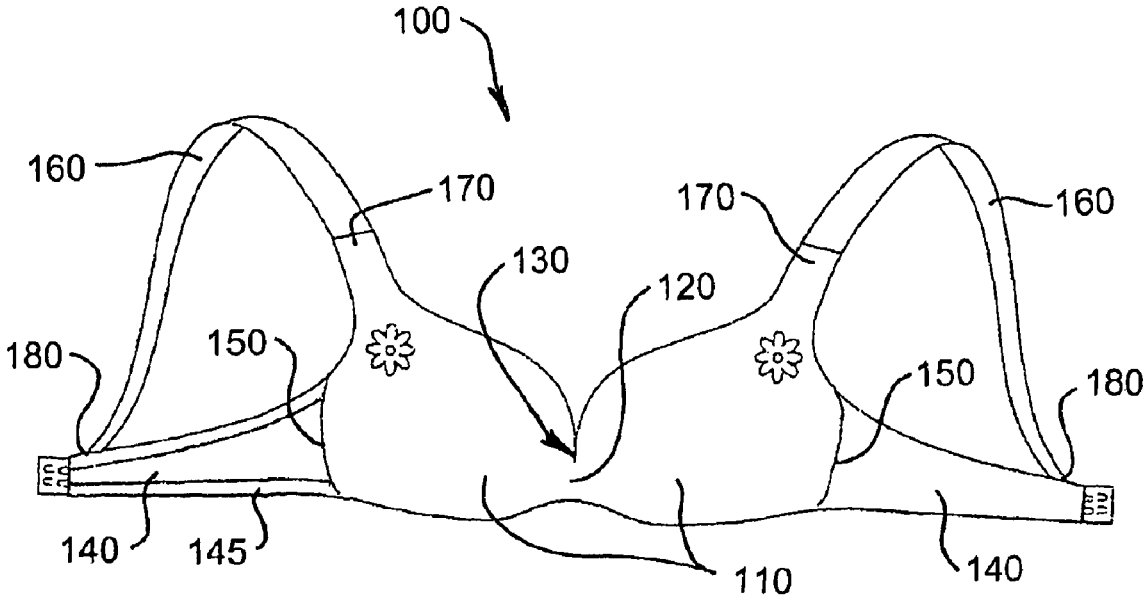
FIG 1 (PRIOR ART)
FIG. 1 is a front on perspective view of a conventional brassiere.

Referring firstly to FIG. 1, there is shown a typical brassiere 100 comprising of a pair of breast cups 110 intended to cover and support the breasts of the wearer, a connector 120 securing together the inner edges of the cups 130 at the wearers cleavage, and at least one strap-like back or wing 140 that extends from the outer edges 150 of the breast cups around the back of the wearer. The brassiere 100 may further include shoulder straps 160 that extend from upper edges 170 of the breast cups 110 over the shoulders of the wearer to attachment points 180 on the back wing or wings 140 crossing the wearer's back.

The present invention is described herein in the context of a front-closure type brassiere wherein the closure means is provided between the breast cups substantially at the wearers cleavage rather than between two back wings as in a back-closure type brassiere, wherein the back of the brassiere is formed by a pair of wings. However, it is to be understood that the improved back wing described herein is equally applicable to a pair of back wings structure for use in connection with a back-closure type brassiere as it is with a single back wing structure for use in connection with a front-closure type brassiere.

In addition, the present invention is applicable to any style or type of brassiere which includes a back wing.

In an embodiment embodying the principles of the present invention, there is provided an improved brassiere which comprises a pair of breast cups 110 having adjacent but spaced apart inner edges 130, a front connector 120 between the breast cups, and a back wing 140 which extends from an outer edge 150 of one of the two breast cups to an outer edge of the other of the two breast cups for securing the brassiere 100 to a torso of a wearer. It should be appreciated that while in this embodiment, the brassiere comprises a single back wing 200 (see FIG. 2A) with releasable closure means provided at the front of the brassiere, the invention is also applicable to a brassiere comprising a pair of back wings (similar to those shown in FIG. 1) releasably connected by appropriate closure means.

Figure 2A:
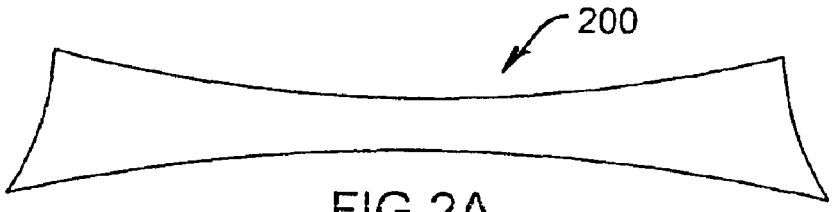
FIG. 2A is a front on view of a back wing embodying the principles of the present invention.

Referring now to FIG. 2A, the back wing structure 200 of the present invention comprises an elastane strap provided within a tube of elastic fabric. Generally the back wing of a brassiere needs to have some elasticity to ensure the comfort of the wearer. Typically this is achieved by composing the back wing or wings of an elastic fabric or providing rubber reinforcing 145 as shown in FIG. 1. The present invention uses substantially 100% elastane (also referred to as spandex) in forming the back wing.

Elastane has exceptional elasticity and is stronger, more durable and lighter in weight than rubber which is commonly used in the manufacture of under garments including brassieres. Elastane has excellent resilience and reverts to its original form post stretching. However, elastane is difficult to dye for improved appearance of the garment, and has a tendency to deteriorate by breakdown of individual fibres. Hiding the elastane within a tube 210 of elastic fabric (see FIG. 2D and FIG. 2F) addresses these problems.

Figure 2B:
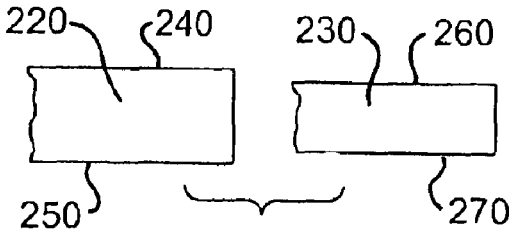
FIG. 2B shows the two elongate pieces of fabric used to form the back wing of FIG. 2A.
Figure 2C:
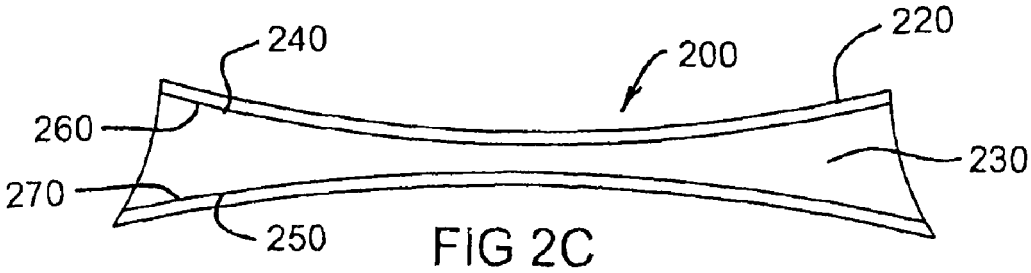
FIG. 2C is a back view of the back wing of FIG. 2A.

Referring now to FIGS. 2B and 2C, the tube 210 of elastic fabric is formed from two elongate pieces of elastic fabric 220 and 230, each elongate piece of fabric having two edges 240,

250, 260 and 270 running generally along the length of the piece of fabric, the edges 240 and 250 of a first elongate piece of fabric 220 and the edges 260 and 270 of a second elongate piece of fabric 230 being bonded together to form the tube 210. The edges 240 and 250 of the first elongate piece of fabric 220 may be bonded to the edges 260 and 270 of the second elongate piece of fabric by any suitable means such as thermal bonding or welding or by the use of a suitable adhesive, or even by sewing. Preferably, the edges are bonded by ultrasonic or high frequency welding.

Figure 2D:
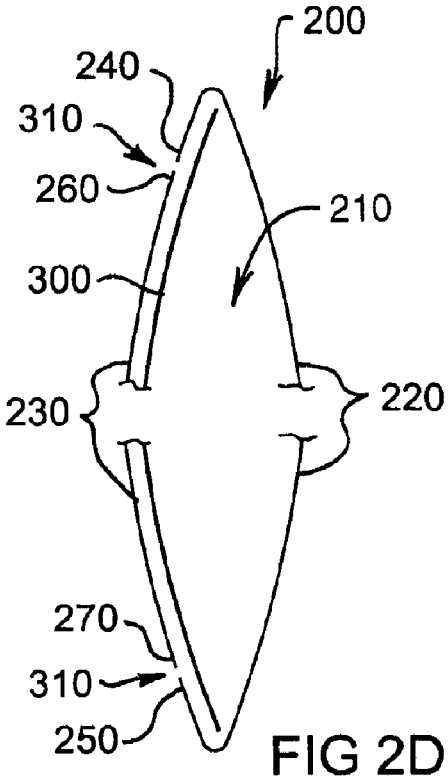
FIG. 2D is a cross sectional view of the back wing of FIGS. 2A and 2C according to an embodiment of the present invention.

As will be apparent from FIGS. 2C and 2D, the size of the first elongate piece of fabric 220 is larger, or preferably slightly larger, across its width, i.e. in a direction substantially perpendicular to the edges 240 and 250 of the first elongate piece of fabric. In forming the tube 210 of elastic fabric, the first elongate piece of fabric 220 is folded over proximal to both its edges 240 and 250 before bonding the edges of the first elongate piece of fabric to the edges 260 and 270 of the second elongate piece of fabric 230. It should be appreciated that the folding can occur before or after the bonding of one or both of the edges of the first elongate piece of fabric 220 to the corresponding edges of the second elongate piece of fabric 230. A contiguous bond is formed between the edges of the first and second elongate pieces of fabric, ie. 240 and 260, and 250 and 270. This arrangement has the advantage of providing an even or a substantially even thickness over the entire length of the back wing, and a smooth surface to be worn against the wearers skin. Moreover, due to the position of the bond, the bond between the first elongate piece of fabric and the second elongate piece of fabric is not visible when the brassiere is fitted to a wearer.

Figure 2E:
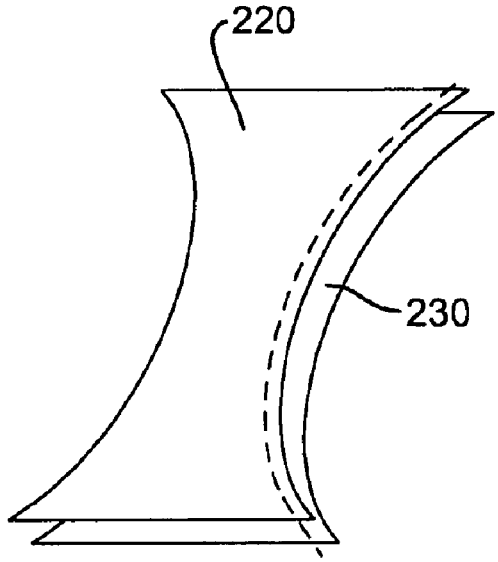
FIG. 2E is a perspective view of the two elongate pieces of fabric used to form the back wing of FIG. 2D.

Referring now to FIG. 2E which shows an example of how a contiguous bond is formed, the contiguous bond between one of the edges 240 and 250 of the first elongate piece of fabric 220 and one of the edges 260 and 270 of the second elongate piece of fabric 230, is formed from ultrasonic cutting (shown by the dashed line in FIG. 2E) of the edges (to be bonded) whilst the two elongate pieces of fabric are laid one on top of the other and suitably aligned. The welding occurs at the same time as the cutting. The other corresponding edges of the first and second elongate pieces of fabric can be bonded in a similar way.

Figure 2F:
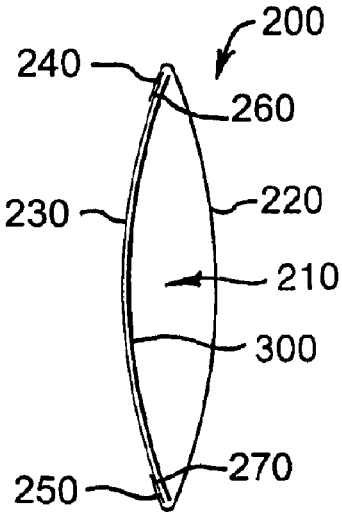
FIG. 2F is a cross sectional view of the back wing of FIGS. 2A and 2C according to an alternative embodiment of the present invention.
Figure 2G:
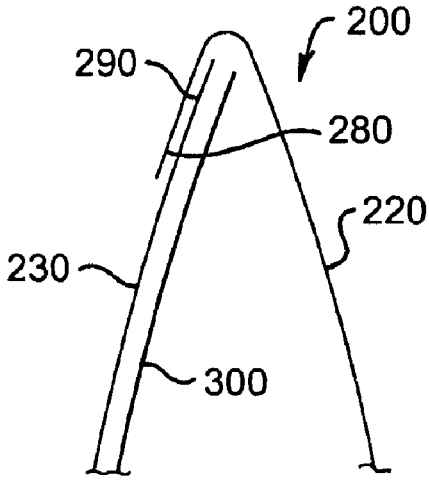
FIG. 2G shows an enlarged view of a portion of the cross section shown in FIG. 2F.

In FIGS. 2F and 2G, an alternative embodiment is shown. In this case, the size of the first elongate piece of fabric is also larger or preferably slightly larger than the second piece of elongate fabric such that the edges 240 and 250 of the first elongate piece of fabric 220 overlap the edges 260 and 270 of the second elongate piece of fabric 230 so that an inner edge 280 of the first elongate piece of fabric 220 is bonded to an outer edge 290 of the second elongate piece of fabric 230 (see FIG. 2E). As with the earlier described embodiment, the bond between the first elongate piece of fabric and the second elongate piece of fabric cannot be seen when the brassiere is fitted to a wearer. Moreover, the overlap or fold over of the first elongate piece of fabric over the edge of the second elongate piece of fabric may provide improved strength for the finished product.

Referring now to FIGS. 2D and 2F, the elastane strap 300 is preferably bonded to at least one of the elongate pieces of fabric. In the illustrated embodiments, the elastane strap is bonded to the second elongate piece of fabric 230 which will eventually form the inner layer of fabric which lies against the skin on a wearers back. Failure to bond the elastane to at least one of the first or second elongate pieces of fabric may result in folds appearing in the elastic fabric in relation to the more resilient elastane. The elastane strap may be bonded to an elongate piece of fabric by any suitable adhesive such as a hot melt adhesive.

In the case of the embodiment shown in FIG. 2D wherein the bond between the edges 240 and 250 of the first elongate piece of fabric 220 and the edges 260 and 270 of the second elongate piece of fabric 230, are contiguous and not overlapping (as shown in FIG. 2D), the elastane strap 300 overlaps the bond 310. This overlapping of the bond 310 by the elastane strap 300 provides backing for the bond and improves the strength of the bond.

The elastic fabric forming the first and second elongate pieces of fabric 220 and 230 should preferably exhibit stretch in at least one direction. The elastic fabric preferably includes an elastane component and preferably comprises substantially 88% nylon and substantially 12% elastane. The elastic fabric may be knitted, woven or similar. Preferably the first and second elongate pieces of fabric are of the same type.

An improved back wing embodying the principles of the present invention is made by forming the tube of elastic fabric as shown for example in FIG. 2D or FIG. 2F, from two elongate pieces of fabric as previously described. An elastane strap is then preferably bonded to one of the elongate pieces of fabric forming the tube. Preferably, the elastane strap is bonded to the second elongate piece of fabric which will eventually form the inner layer of fabric which lies against the wearers skin. The tube is then turned inside out such that the elastane strip is located within the tube as shown in FIGS. 2D and 2F. The tube is then trimmed to size ready for attachment to the other components required to assemble a complete brassiere. If the back wing is intended for a back-closure brassiere, the back wing structure as illustrated is also cut in half for engagement of suitable closure means.

Bonding of the elastane strap to the elongate piece of fabric forming part of the tube is preferably achieved by means of hot melt adhesive. The hot melt adhesive may for example, be applied through use of a release paper. This involves the adhesive first being applied to a release paper, and the adhesive then being transferred to the elastic fabric or the elastane by an application of heat. Moreover, the hot melt adhesive is preferably applied at selected locations either along the elastane strap or the elongate piece of fabric. This ensures that resilience of the elastane is not compromised upon bonding to the elastic fabric. Preferably, the hot melt adhesive is applied in dot cotted form.

Bonding of the edges of the first elongate piece of fabric to the edges of the second elongate piece of fabric is preferably achieved by ultrasonic or high frequency welding which provides a "smooth" bond.

It is an advantage of the present invention that the back wing is relatively thin, has smooth outer and inner surfaces and provides good air permeability. The back wing has superior resilience and provides improved comfort for the wearer by ensuring that pressure is evenly distributed across the wearers skin.

Moreover, when comparing the back wing of the present invention with a back wing formed entirely of elastane, the present invention provides an advantage that the elastane is hidden from view. Also, in an elastane blended fabric, stretching of the fabric can cause the elastane to become visible particularly when the elastane content is relatively large and this is also not desirable.

The principles of the present invention are also applicable to other types of garment, such as panties, underpants and sportswear, etc., where superior resilience coupled with good comfort are desired, by substituting the structure of the back wing as hereinabove described for the portion or component of the garment in question desiring superior resilience. Thus, this invention also provides an improved garment, the garment including at least a resilient component or portion thereof, the portion or component comprising an elastane strap provided within a tube of elastic fabric. The shape of the elastane strap and of the tube of elastic fabric can in such case be appropriately adjusted to fit the shape of the portion or component of the garment in question. All the other technical features of the present invention are similarly applicable to such garments.

While the invention has been described in conjunction with a limited number of embodiments, it will be appreciated by those skilled in the art that many alternative, modifications and variations in light of the foregoing description are possible. Accordingly, the present invention is intended to embrace all such alternative, modifications and variations as may fall within the spirit and scope of the invention as disclosed.

The invention claimed is:

1. A brassiere comprising:

a pair of breast cups having adjacent but spaced apart inner edges;

a front connector between the breast cups; and a back wing extending from an outer edge of at least one of the two breast cups;

wherein the back wing is comprised of an elastane strap having edges and a tube that is comprised of elastic fabric having portions that are folded over the edges of the elastane strap, the elastane strap being within the tube and the edges of the elastane strap being hidden from view by the portions of the elastic fabric that are folded over the edges of the elastane strap.

2. A brassiere according to claim 1, wherein the tube of elastic fabric is formed from two elongate pieces of elastic fabric, each elongate piece of fabric having two edges running generally along the length of the piece of fabric, the edges of a first elongate piece of fabric and the edges of a second elongate piece of fabric being bonded together to form the tube.

3. A brassiere according to claim 2, wherein the edges of the first elongate piece of fabric are bonded to the edges of the second elongate piece of fabric by ultrasonic welding.

4. A brassiere according to claim 2, wherein the first elongate piece of fabric is wider than the second elongate piece of fabric such that the first elongate piece of fabric is folded over proximal to its edges and the edges of the first elongate piece of fabric are bonded to the edges of the second elongate piece of fabric.

5. A brassiere according to claim 2, wherein the edges of the first elongate piece of fabric overlap the edges of the second elongate piece of fabric such that an inner edge of the first elongate piece of fabric is bonded to an outer edge of the second elongate piece of fabric.

6. A brassiere according to claim 2, wherein the elastane strap is bonded to at least one of the elongate pieces of fabric.

7. A brassiere according to claim 6, wherein the elastane strap is bonded to the elongate piece of fabric by hot melt adhesive.

8. A brassiere according to claim 1, wherein the elastane strap comprises substantially 100% elastane.

9. A brassiere according to claim 1, wherein the elastic fabric exhibits stretch in at least one direction.

10. A brassiere according to claim 1, wherein the elastic fabric includes an elastane component.

11. A brassiere according to claim 10, wherein the elastic fabric comprises substantially 88% nylon and substantially 12% elastane.

12. A back wing for a brassiere configured to extend from an outer edge of at least one of two breast cups of the brassiere;

the back wing being comprised of an elastane strap within a tube of elastic fabric, wherein the tube of elastic fabric is formed from a first elongate piece of fabric and a second elongate piece of fabric, each elongate piece of fabric having two edges running generally along its length, wherein the first elongate piece of fabric is wider than the second elongate piece of fabric such that the first elongate piece of fabric is folded over proximal to its edges and the edges of the first elongate piece of fabric are bonded to the edges of the second elongate piece of fabric to form the tube.

13. A back wing according to claim 12, wherein the edges of the first elongate piece of fabric are bonded to the edges of the second elongate piece of fabric by ultrasonic welding.

14. A back wing according to claim 12, wherein the edges of the first elongate piece of fabric overlap the edges of the second elongate piece of fabric such that an inner edge of the first elongate piece of fabric is bonded to an outer edge of the second elongate piece of fabric.

15. A method of making a back wing of a brassiere, the method comprising the following steps:

forming a tube of elastic fabric from two elongate pieces of fabric, each elongate piece of fabric having two edges running generally along the length of the piece of fabric, the edges of a first elongate piece of fabric and the edges of a second elongate piece of fabric being bonded together to form the tube;

bonding an elastane strap to one of the elongate pieces of fabric forming part of the tube;

turning the tube inside out such that the elastane strip is located inside the tube; and trimming the tube of elastic fabric.

16. A method of making a back wing according to claim 15, wherein the edges of the first elongate piece of fabric are bonded to the edges of the second elongate piece of fabric by ultrasonic welding.

17. A method of making a back wing according to claim 15, wherein the elastane strap is bonded to the elongate piece of fabric forming part of the tube using holt melt adhesive.

18. A brassiere comprising:

a pair of breast cups having adjacent but spaced apart inner edges;

a front connector between the breast cups; and a back wing extending from an outer edge of at least one of the two breast cups;

wherein the back wing is comprised of an elastane strap within a tube of elastic fabric, wherein the tube of elastic fabric is formed from two elongate pieces of elastic fabric, each elongate piece of fabric having two edges running generally along the length of the piece of fabric, the first elongate piece of fabric and the second elongate piece of fabric being bonded together to form the tube, and wherein the tube has a configuration selected from a group consisting of a first configuration in which the first elongate piece of fabric is wider than the second elongate piece of fabric and the first elongate piece of fabric is folded over proximal to its edges and the edges of the first elongate piece of fabric are bonded to the edges of the second elongate piece of fabric, and a second configuration in which the edges of the first elongate piece of fabric overlap the edges of the second elongate piece of fabric such that an inner edge of the first elongate piece of fabric is bonded to an outer edge of the second elongate piece of fabric.

19. A brassiere according to claim 18, wherein the back wing extends to an outer edge of the other of the two breast cups.

20. A brassiere according to claim 1, wherein the back wing extends to an outer edge of the other of the two breast cups.

* * * * *